US011250692B2

(12) United States Patent
Haug

(10) Patent No.: US 11,250,692 B2
(45) Date of Patent: Feb. 15, 2022

(54) REMOTE CONTROL ARRANGEMENT

(71) Applicant: Thomas Haug, Birkenfeld (DE)

(72) Inventor: Thomas Haug, Birkenfeld (DE)

( * ) Notice: Subject to any disclaimer, the term of this patent is extended or adjusted under 35 U.S.C. 154(b) by 58 days.

(21) Appl. No.: 16/632,786

(22) PCT Filed: Jul. 24, 2018

(86) PCT No.: PCT/EP2018/069995
§ 371 (c)(1),
(2) Date: Jan. 21, 2020

(87) PCT Pub. No.: WO2019/029983
PCT Pub. Date: Feb. 14, 2019

(65) Prior Publication Data

US 2020/0211365 A1 Jul. 2, 2020

(30) Foreign Application Priority Data

Aug. 9, 2017 (DE) ..... 20 2017 104 769.5

(51) Int. Cl.
*G08C 17/02* (2006.01)
*B66C 13/40* (2006.01)

(52) U.S. Cl.
CPC ..... *G08C 17/02* (2013.01); *B66C 13/40* (2013.01); *G08C 2201/60* (2013.01); *G08C 2201/91* (2013.01); *G08C 2201/93* (2013.01)

(58) Field of Classification Search
CPC ..... G08C 17/02; G08C 2201/60
See application file for complete search history.

(56) References Cited

U.S. PATENT DOCUMENTS 10,306,046 B2 5/2019 Musial
2013/0200997 A1 8/2013 Miller et al.
2016/0217684 A1* 7/2016 Bossier ..... G08C 17/02

FOREIGN PATENT DOCUMENTS

DE 202008008445 U1 12/2009
DE 10 2013 203 950 A1 9/2013
(Continued)

OTHER PUBLICATIONS

International Search Report, issued in PCT/EP2018/069995, dated Oct. 9, 2018.

*Primary Examiner* — Daniell L Negron
(74) *Attorney, Agent, or Firm* — Birch, Stewart, Kolasch & Birch, LLP

(57) ABSTRACT

A remote control arrangement includes a portable computer, in which a computer program product for generating and transmitting control signals by transmitter provided on the computer is stored, and a remotely controlled object, on which a receiver for receiving the control signals and a controller for controlling the object in accordance with the received signals are provided. The remote control arrangement has a security device having an operating element that can be mechanically actuated. A security control connection can be established between the security device and the portable computer, and control of the object can be allowed only when the security control connection is established. The security control connection includes an electronic signal connection between the security device and the computer. The control signals for moving the object cannot be transmitted until the electronic signal connection exists. The security device has a security transmitter, by which a termination signal preventing the movement of the object can be transmitted.

20 Claims, 4 Drawing Sheets

(56) References Cited

FOREIGN PATENT DOCUMENTS

Figure 1:
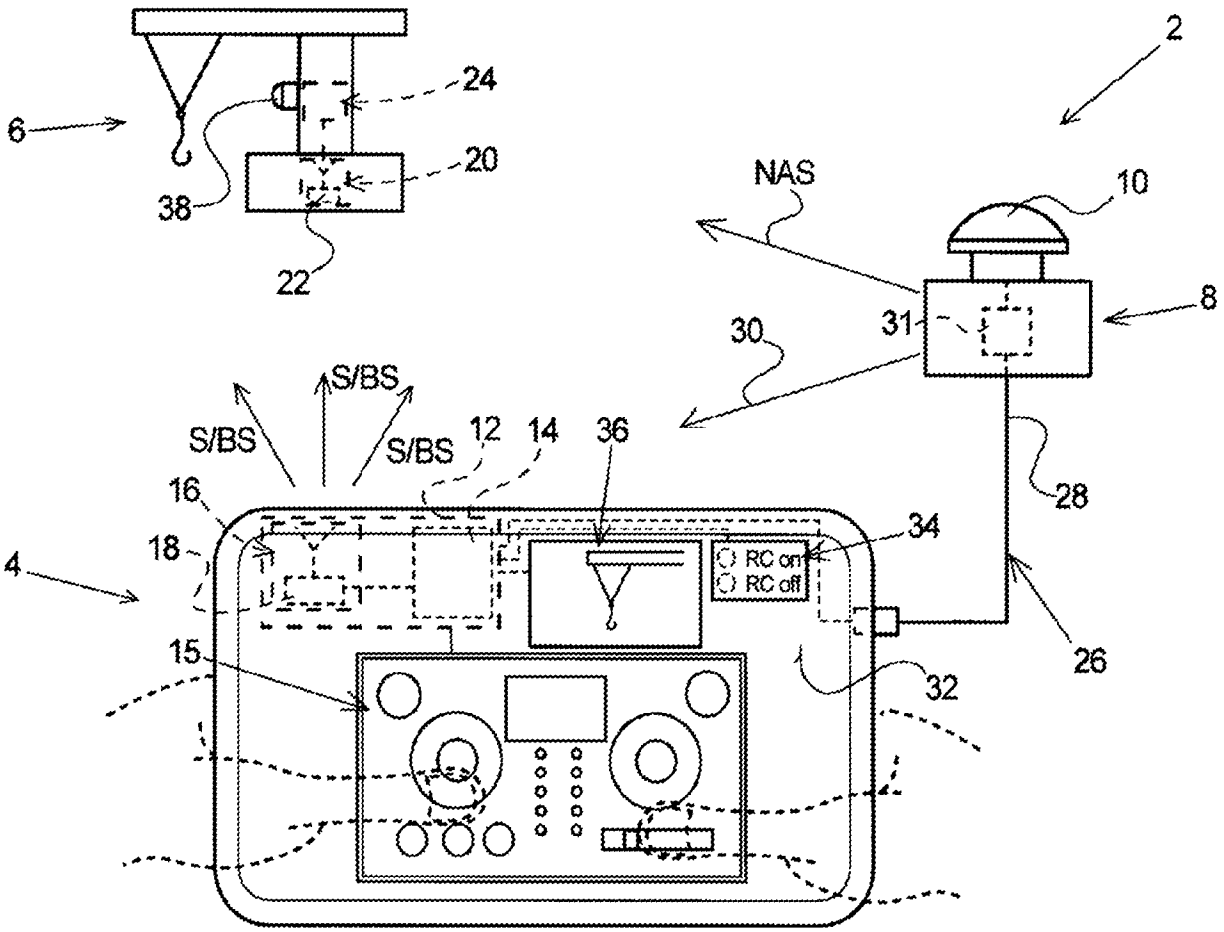

| | | | |
|---|---|---|---|
| DE | 10 2015 220 229 | A1 | 4/2017 |
| EP | 2138985 | A2 | 12/2009 |
| WO | WO 2009/120958 | A2 | 10/2009 |
| WO | WO 2012/091227 | A1 | 7/2012 |
| WO | WO 2014/127822 | A1 | 8/2014 |
| WO | WO 2016/026023 | A1 | 2/2016 |

* cited by examiner

REMOTE CONTROL ARRANGEMENT

The invention relates to a remote control arrangement according to the preamble of claim 1 and to a method for operating the remote control arrangement. The remote control arrangement comprises a portable computer, such as, in particular, a tablet computer or a smartphone with a touch-sensitive display for inputting control commands, wherein a computer program product is stored and can be executed on the computer, by means of which control signals are generated from the input control commands and can be transmitted by means of transmission means provided on the computer. The remote control arrangement further comprises a remote-controlled object, such as a vehicle or a lifting device, on which receiving means for receiving the control signals and control means for controlling the object in accordance with the received control signals are provided. The remote control arrangement further comprises a safety device, which is configured separately from the computer, with an operating element that can be mechanically actuated and which is formed, for example, as a push button that can be moved by the application of force or as another actuator that can be manually actuated, such as a switch, a lever or an operating panel. By this means, a safety control connection can be established between the safety device and the portable computer, and, depending on the existence of that safety control connection, a movement of the remote-controlled object can be blocked or terminated. Thus, the relevant object can only be set in motion as and when this safety control connection is established. This ensures that an object which is remotely controlled by means of a conventional portable computer moves out of the starting position as a result of transmitted control signals only when a safety device is activated at the same time. In this case, the safety control connection comprises an electronic signal connection between the safety device and the computer. As a result, the existence or disruption of the safety control connection can be particularly reliably and easily recognised and signalled to the computer. The control signals can thereby only be transmitted by the computer to the remote-controlled object after the existence of the electronic safety control connection has been established. In order to be able to assume a stable safety control connection, the computer program product preferably only activates the transmission of the control signals when the electronic signal connection is sufficiently stable according to predetermined criteria or when the safety control connection has existed for a predetermined length of time and only as long as the electronic signal connection between the computer and the safety device exists. As a result, the object can only be remotely controlled by means of the portable computer if and for as long as the safety device is connected to the computer via a sufficiently stable connection, In this way, particularly secure operation of the remote control arrangement can be ensured.

Remote-controlled objects such as model cars, robots or drones are currently available on the market and can be controlled using conventional laptops, tablet computers or smartphones. For this purpose, computer program products are offered that can be run on the portable computers concerned, in order to convert the control commands input on them into control signals, which in turn are transmitted to the remote-controlled objects to execute the desired movements.

A disadvantage of these known remote control arrangements is that, for safety reasons, they can only be used for controlling relatively small objects, such as in particular in the field of models or for small flying drones.

US 2017/0111487 A1 describes an arrangement for remote control of a vehicle by means of a tablet computer. To transmit control signals to the vehicle, the tablet computer must be connected to a key device that transmits an identification code and has a dead man's switch. If there is no signal from the dead man's switch, an ongoing remote control process is ended immediately.

US 2013/0200997 A1 describes a dead man's system in which the operation of a device can be made dependent on the transmission of biometric identification data in addition to the transmission of signals from a dead man's switch.

WO 2014/127822 A1 shows an arrangement comprising a robot that can be operated via a control unit. The control data can be transmitted to the control unit by means of a portable computer. The operation of the robot depends on the additional reception of signals that are transmitted by a dead man's switch to the control unit.

A disadvantage of the known remote control arrangements having a safety device formed by a dead man's switch is that in such a case the remote control can be ended by the operator only by releasing the dead man's switch. In addition, in the case of remote control arrangements operated in this way, simply ending the transmission of control signals does not guarantee that the remote-controlled object can be reliably fixed at a position that is safe or convenient for the persons located in the working area of the object. In addition, in the known arrangements the spatial distance within which the remote-controlled object can be controlled or stopped by means of the portable computer and the safety device is relatively small. For many, in particular industrial, applications, the known remote control arrangements comprising a portable computer are therefore not suitable.

The object of the invention is to provide a generic remote control arrangement which avoids the disadvantages mentioned above, and enables a larger field of application of portable computers for remote control of objects in the professional or industrial field. This object is achieved by a remote control arrangement having the features of claim 1. Thus, the safety device itself has safety transmission means, by means of which a signal preventing the movement of the object can be transmitted. In this way, a termination signal can also be transmitted independently of the portable computer in order to prevent a movement of the remote-controlled object if the safety control connection is absent or interrupted, or to terminate or block said movement when the operating element, such as a commercially available emergency stop button, is actuated. As a result, the remote control process or a movement of the remote-controlled object generated thereby can be abruptly terminated in an emergency by actuating the mechanical operating element, for example in the manner of an emergency stop device. The object to be controlled can be brought into a secure and, for example, predefined position and fixed in this position by the actively transmitted termination signal. The relevant portable computer can thus also be used for remote control of large objects, such as cranes or industrial lifting or transport devices, and in the event of danger, the movement of the object can be prevented or terminated at any time by actuating the operating element. The operating element can be actuated both by the user himself and by other persons. In this way, the potential use of a portable computer available on site can be extended to use as a remote control for additional, in particular industrial or commercial, fields of application, which also saves the costs of an additional remote control apparatus.

In this case, it is advantageous if the safety transmission means can be deactivated or are deactivated when the safety control connection is established, in order to enable undisturbed remote control operation when the safety function exists.

In addition to this, a blocking control signal can be provided which can be transmitted by the portable computer and prevents a movement of the remote-controlled object when the safety control connection is disrupted, and that can only be deactivated or is only deactivated when the safety control connection is established. This can ensure that the portable computer, when switched on, actively blocks a movement of the remote-controlled object until the safety control connection is established.

In this case, it is advantageous if the blocking control signal can be activated by actuating the operating element. As a result, the blocking control signal can be activated via the safety device even when the safety control connection exists, in order to be able to terminate or prevent a movement of the object, particularly in the event of danger.

Furthermore, it is favourable if the existence of the safety control connection of the computer with the safety device can be indicated, for example, on a display of the computer or by an optical signal. As a result, the user of the remote control arrangement can be informed at any time as to whether the safety device is available and thus whether remote control of the object concerned is possible or not.

Advantageously, a working area of the remote-controlled object can also be shown on a display of the computer. As a result, the portable computer can additionally be used to indicate to the user, for example by means of at least one camera, a working area of which he has no direct view.

In addition, it is favourable if the electronic signal connection can be established using a physical plug connection. In this way, a particularly stable data exchange between the safety device and the portable computer is guaranteed.

Advantageously, the physical plug connection can in such a case be formed on a receptacle into which the portable computer can be inserted and on which the safety device is provided or integrated. Such a plug connection, which is formed, for example, on an additional housing, thus enables a direct connection of the portable computer with the safety device, so that, during the input of control commands on the portable computer, the operating element is directly available on the portable computer and can be actuated.

Alternatively, it is favourable if the physical plug connection between the safety device and the portable computer can be established via a connecting cable. In this way, it is possible, for example, to connect the safety device with various portable computers using a conventional cable, such as a USB cable.

In a further alternative embodiment, the electronic signal connection can be established via a wireless connection. In this way, the electronic signal connection between the portable computer and the safety device can be established in a particularly convenient manner. In this case, it is advantageous if the wireless connection can be established via optical signal transmission means. This makes it possible, for example, to use an optical signal generator that cooperates with an optical signal detector and to provide a coding via the optical signals which ensures that the electronic signal connection is established exclusively between specified devices. As an alternative or in addition to this, it is favourable if the wireless connection can be established via a radio connection, such as, for example, via a Bluetooth or WLAN connection, as a result of which the electronic signal connection can be established without interference, for example even in the absence of an optical connection between the devices, and even outdoors.

In a further advantageous embodiment, the safety device has a signal converter device, by means of which the control signals issued by the computer can be changed and then transmitted from the safety device. In this way, it is possible to transmit the control signals transmitted by means of the safety device in a different format or with a higher transmission power than is possible with the transmission means of the computer. In this way, in particular, a greater range and a more stable transmission of the control signals can be achieved. The signal converter device has amplification means by means of which the signals received from the computer can be amplified. In this way, the control signals transmitted by the computer can also be transmitted from the signal converter device of the safety device in the same format with a higher transmission power in order to enable a greater range.

Advantageously, the signal converter device has conversion means, by means of which the control signals received from the computer in a first format can be converted into a second format in which the control signals can be transmitted from the safety device. As a result, for example, WLAN signals transmitted by the computer can be received by the safety device and transmitted in the form of radio signals at a different frequency in order to ensure a greater range or a higher stability of the control signals.

The stated object is further achieved by a method for operating a remote control arrangement in one of the above-mentioned embodiments, wherein after activation of the computer program product on the portable computer in a first step a movement of the remote-controlled object is prevented. In a subsequent second step, it is then checked repeatedly whether a safety control connection exists between the safety device and the computer. If the computer program product establishes the existence of the safety control connection, for example by receiving corresponding signals from the safety device over a predetermined period of time, then in a subsequent third step the transmission of control signals to the remote-controlled object is activated. These control signals are generated by the computer program product in accordance with the control commands input on the computer. If, during this remote control operation, the computer program product detects a termination of the safety control connection, for example due to corresponding signals not being received or insufficient corresponding signals being received by the safety device, or if a termination signal is received by the safety device as a result of the actuation of the operating element, then in a subsequent fourth step the movement of the remote-controlled object is again prevented. In this way, it can be ensured that the remote control of the relevant object by means of the portable computer can only take place if there is a stable connection with the safety device. On the other hand, as soon as a stable connection cannot be guaranteed or the safety device is activated, the control of the object is terminated for safety reasons.

In an advantageous embodiment of the method, the movement of the remote-controlled object is prevented by the transmission of termination signals from the safety device. In this way, the movement of the object can also be prevented or terminated independently of the computer.

Alternatively, the movement of the remote-controlled object can be prevented by the transmission of termination signals from the portable computer, which are transmitted, for example, in parallel with or instead of the control signals.

As a result, it is possible to actively control the object and thereby to block or terminate a movement thereof particularly reliably.

Advantageously, in the third step an indication on the display is additionally activated, which signals the active state of the safety device and thus that the transmission of control signals for remote control of the object is possible.

It is pointed out that all the features of the subject matter according to the invention described above are interchangeable or combinable, provided that an exchange or a combination thereof is not ruled out for technical reasons.

Figure 2:
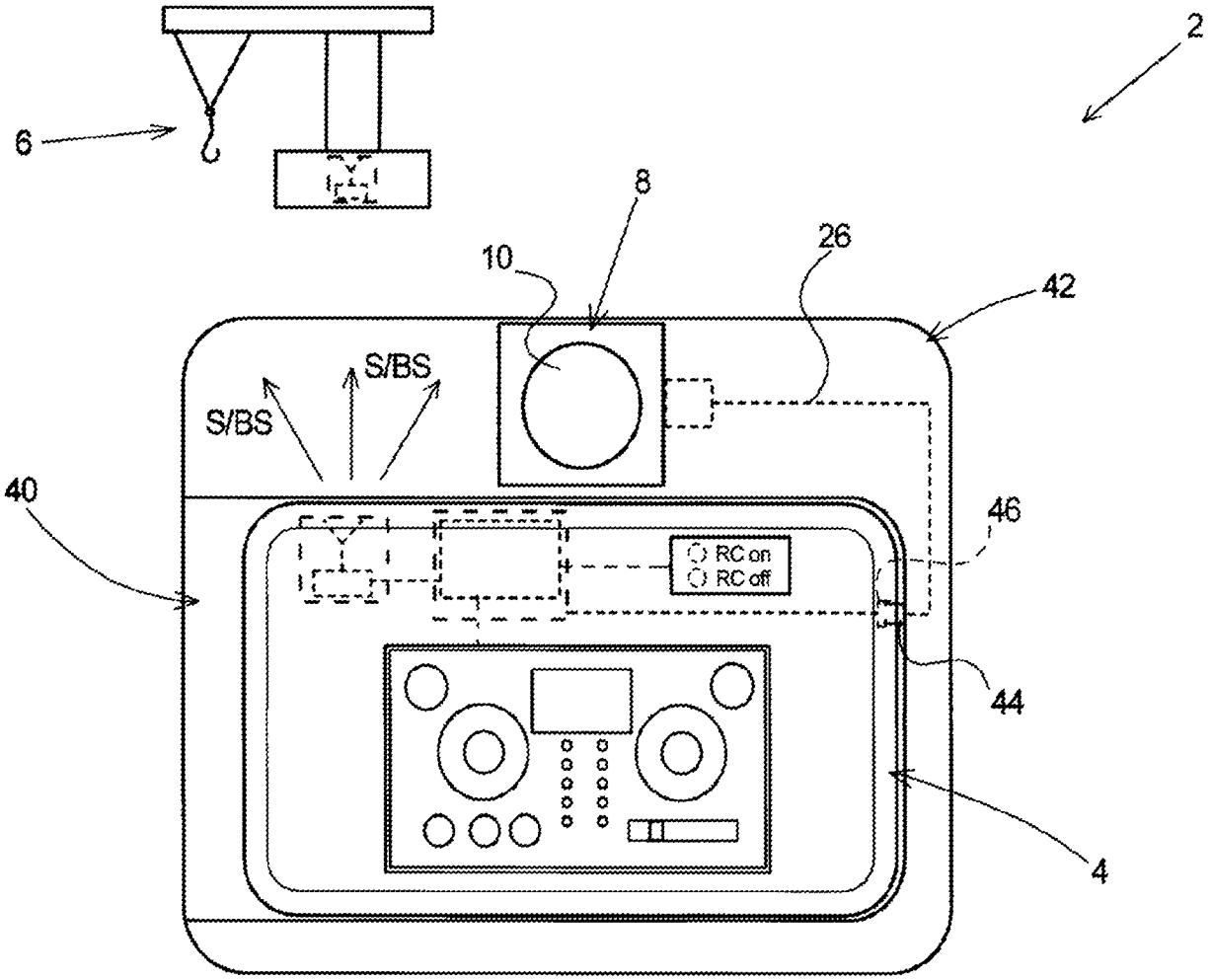
Figure 3:
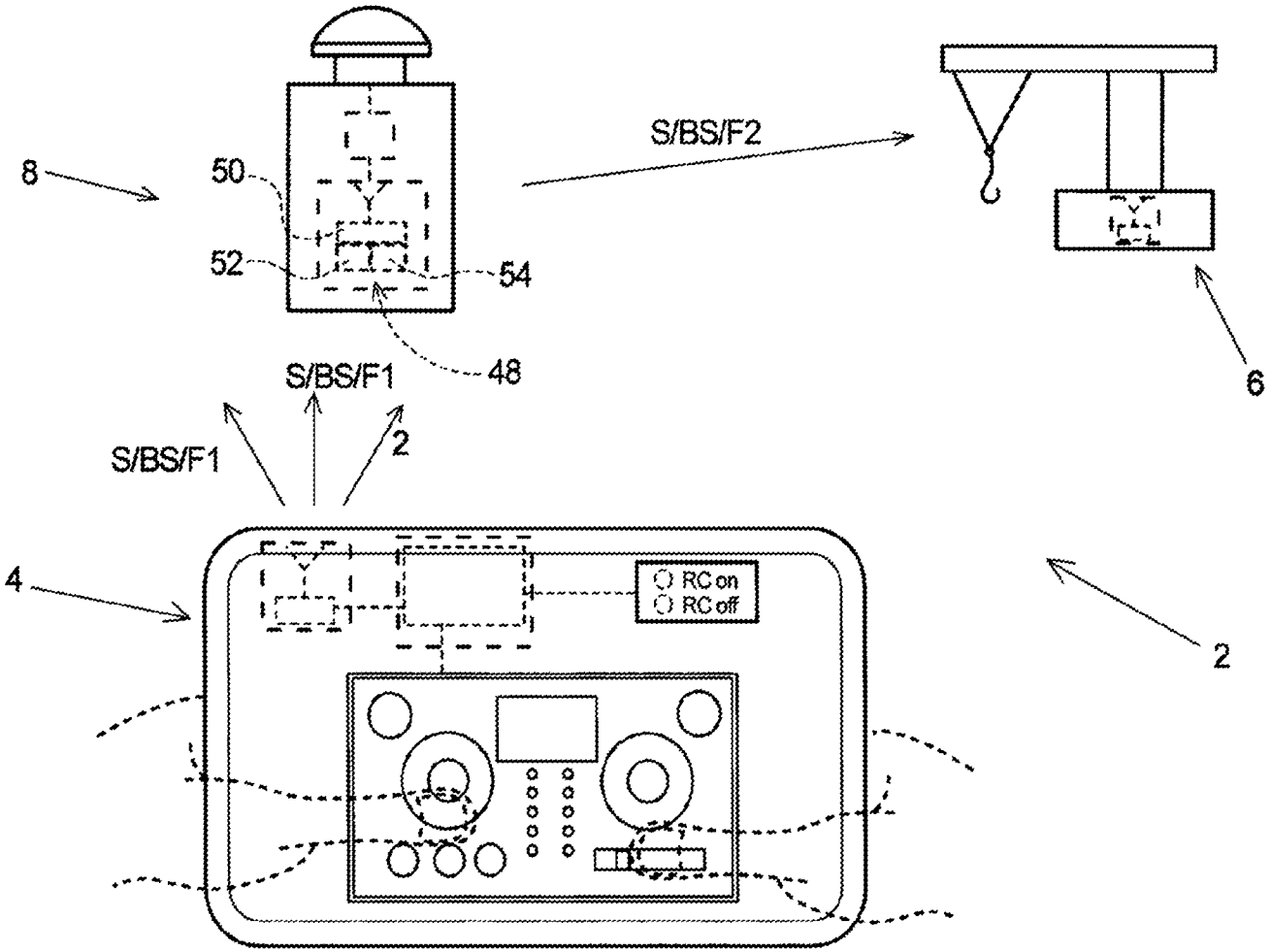
Figure 4:
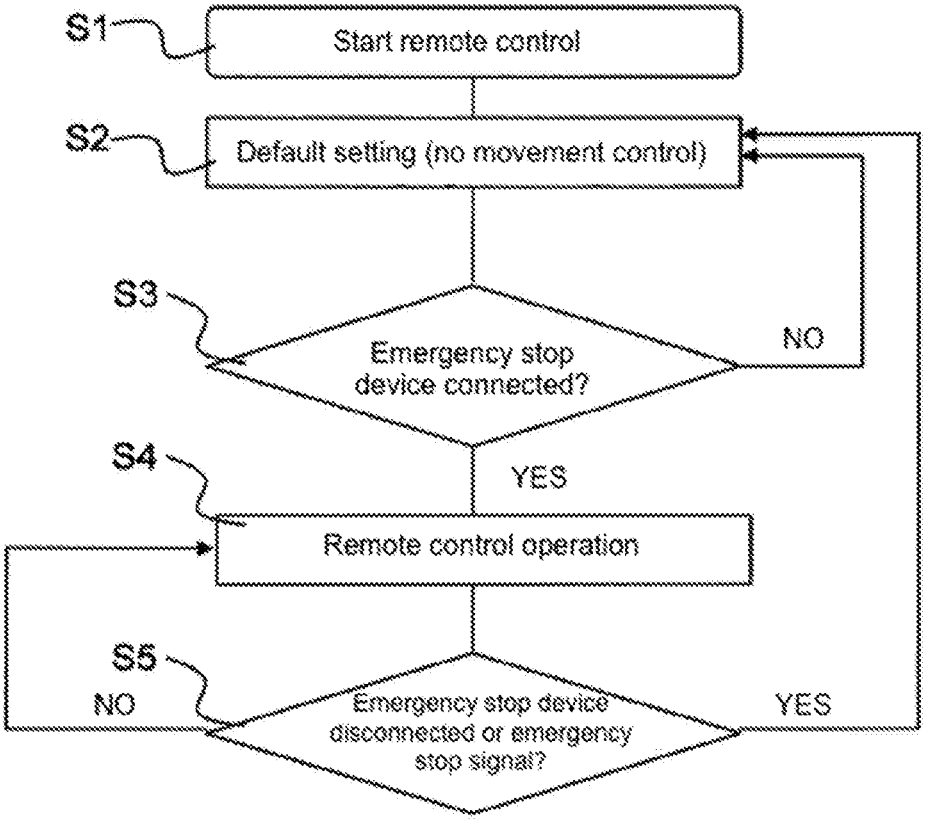

An exemplary embodiment of the invention is shown in the Figures, wherein:

FIG. 1 is a view of a remote control arrangement according to the invention comprising a portable computer, a safety device and a remote-controlled object, FIG. 2 is a view of the remote control arrangement with an alternative embodiment of the safety device, FIG. 3 is a view of the remote control arrangement with a further alternative embodiment of the safety device and FIG. 4 is a flow diagram of a computer program product which is stored and can be executed on the portable computer of the remote control arrangement.

FIG. 1 shows a remote control arrangement 2 comprising a portable computer 4 in the form of a tablet computer or a smartphone, a remote-controlled object 6 in the form of a lifting device and a safety device 8. The safety device 8, which is designed in the manner of an emergency stop device, has an operating element 10 in the form of a commercially available emergency stop button that can be mechanically actuated to generate a termination signal. For this purpose, the operating element 10 is formed, for example, by a push button or switch that can be moved by the application of force.

The computer 4 has an electronics system 12, in which a computer program product 14 is stored and can be executed. The computer program product 14 serves to generate control signals S and/or blocking control signals BS and to transmit them to the remote-controlled object 6. For this purpose, the computer 4 has an arrangement 15 of virtual and/or physical input elements for the input of control commands as well as transmission means 16, which, for example, comprise a computer-side transceiver 18.

The remote-controlled object 6 in turn has receiving means 20 for receiving the control signals S and/or the blocking control signals BS, which receiving means 20 comprise, for example, a transceiver 22 on the object side. The signals received via this transceiver 22 and the control commands resulting therefrom are transferred to control means 24 of the object 6, via which the remote-controlled object 6 can be appropriately controlled or set in motion.

As can also be seen from FIG. 1, a safety control connection 26 can be established between the portable computer 4 and the safety device 8. This comprises an electronic signal connection, which is established, for example, via a connecting cable 28 or a wireless connection 30. The wireless connection 30 can in this case be configured in particular as a radio, WLAN, infrared and/or Bluetooth connection. Moreover, the safety device 8 can have safety transmission means 31, by means of which termination signals NAS can be transmitted directly to the object 6 when the operating element 10 is actuated or when the safety control connection 26 is disrupted, in order to stop or block the movement of said object.

In addition, as shown in FIG. 1, an indication 34 is provided on a display 32 of the computer 4, on which can be signalled whether the safety control connection 26 exists or not. The display 32 of the computer 4 can also be used to display images of a working area of the remote-controlled object 6 within a monitoring display 36. The images can be continuously captured, for example by means of a camera 38 provided on the object 6, and transmitted to the computer 4.

FIG. 2 shows an alternative embodiment of the remote control arrangement 2, in which the computer 4 is accommodated in a receptacle 40 of an additional housing 42. Here, the safety device 8 is integrated into the additional housing 42 or is held thereon. To establish the safety control connection 26 between this safety device 8 and the computer 4, the additional housing 42 has a contact plug 44, which is positioned in such a way that, when the computer 4 is inserted into the receptacle 40, it comes into contact with a plug socket 46 of the computer 4, such as, in particular, a USB socket. This contact plug 44 is then connected with the safety device 8, as can be seen in FIG. 2, so that when the contact is established between the contact plug 44 and the plug socket 46, the safety control connection 26 is also established at the same time.

A further embodiment of the remote control arrangement 2 is shown in FIG. 3. This has a safety device 8 that is separated from the computer 4 and has an additional signal converter device 48. A transceiver 50, for example, is provided on this signal converter device 48, by means of which transceiver the control signals S transmitted by the computer 4 can be both received and transmitted further. In order to achieve a greater range in the transmission of the control signals S, the signal converter device 48 has conversion means 52, by means of which the control signals S transmitted by the computer 4 in a first format F1 can be converted into a second format F2. For example, the control signals S can be converted from a WLAN or Bluetooth format used by the computer 4 into a radio format with a different frequency, which ensures a greater range or a more stable radio connection with the remote-controlled object.

As an alternative or in addition to this, the signal converter device 48 can have amplification means 54, by means of which the control signals S received by the computer 4 are amplified during the forwarding from the safety device 8, in order to thereby increase the range.

It is pointed out that all the elements and features of the various embodiments of the subject matter according to the invention described above are interchangeable or combinable, provided that an exchange or a combination thereof is not ruled out for technical reasons.

The mode of operation of the remote control arrangement 2 is described below using the sequence according to FIG. 4:

In a first step S1, remote control of the object 6 is started by switching on the computer 4. Immediately thereafter, in a second step S2, the computer program product 14 puts the computer 4 into a default setting, in which a movement control is prevented in order to avoid inadvertent movement of the remote-controlled object 6. The movement control is prevented either by a lack of transmission of the control signals S, by the active blocking control signals BS, which are transmitted by the computer 4 to the object 6, or by the active termination signals NAS, which are transmitted by safety transmission means 31 of the safety device 8 to the object 6.

In a third step S3, it is then examined whether the safety control connection 26 with the safety device 8 is established. If not, the computer program product 14 leaves the computer 4 in the default setting.

If, on the other hand, a stable safety control connection 26 is determined according to specified criteria, then in a fourth step S4 the computer program product 14 enables the remote control operation of the computer 4, so that when control commands are input on the computer 4, corresponding control signals S are now generated and transmitted. Where appropriate, the transmission of the blocking control signals by the computer 4 or the termination signals by the safety device 8 are terminated at the same time.

During this remote control operation, it is repeatedly checked in a fifth step S5 whether the safety control connection 26 is disrupted or whether a termination signal has been generated on the safety device 8. As long as these two conditions are not met, the remote control operation continues.

If, on the other hand, it is determined that the safety control connection 26 between the computer 4 and the safety device 8 is disrupted or if by actuation of the operating element 10 a termination signal is generated by the safety device 8, then the computer program product 14 puts the computer 4 back into the default setting as in the second step S2. As a result, the transmission of the control signals S is terminated or the transmission of the blocking control signals or the termination signals is reactivated, thereby preventing a further movement or displacement of the remote-controlled object 6, in order in particular to prevent danger to persons or damage to property.

The invention claimed is:

1. A remote control arrangement comprising:

a portable computer, on which a computer program for generating and transmitting control signals with a transmitter provided on the computer is stored;

a remote-controlled object, on which a receiver configured to receive the control signals and a controller configured to control the object in accordance with the received signals are provided; and a safety device having an operating element that can be mechanically actuated, wherein a safety control connection can be established between the safety device and the portable computer, control of the object can be allowed only when the safety control connection is established, wherein the safety control connection comprises an electronic signal connection between the safety device and the computer, wherein the control signals for moving the object cannot be transmitted until the electronic signal connection exists, wherein the safety device has a safety transmitter by which a termination signal preventing the movement of the object can be transmitted, and wherein the termination signal includes an active termination signal transmitted directly from the safety device to the remote-controlled object upon activation of the operating element.

2. The remote control arrangement according to claim 1, wherein a blocking control signal preventing the movement of the object can be transmitted from the portable computer and can be deactivated when the safety control connection is established and can be activated by actuation of the operating element.

3. The remote control arrangement according to claim 2, wherein the existence of the safety control connection of the computer with the safety device can be signalled on the computer.

4. The remote control arrangement according to claim 1, wherein the existence of the safety control connection of the computer with the safety device can be signalled on the computer.

5. The remote control arrangement according to claim 1, wherein a working area of the remote-controlled object can be shown on a display of the computer.

6. The remote control arrangement according to claim 1, wherein the safety control connection can be established via a physical plug connection.

7. The remote control arrangement according to claim 6, wherein the physical plug connection can be established on a receptacle into which the portable computer can be inserted and on which the safety device is provided.

8. The remote control arrangement according to claim 6, wherein the physical plug connection between the safety device and the computer can be established via a connecting cable.

9. The remote control arrangement according to claim 1, wherein the safety control connection can be established via a contactless/wireless connection.

10. The remote control arrangement according to claim 1, wherein the safety control connection can be established via an optical signal transmitter or via a radio connection.

11. A remote control arrangement comprising:

a portable computer, on which a computer program for generating and transmitting control signals with a transmitter provided on the computer is stored;

a remote-controlled object, on which a receiver configured to receive the control signals and a controller configured to control the object in accordance with the received signals are provided; and a safety device having an operating element that can be mechanically actuated, wherein a safety control connection can be established between the safety device and the portable computer, and control of the object can be allowed only when the safety control connection is established, wherein the safety control connection comprises an electronic signal connection between the safety device and the computer, wherein the control signals for moving the object cannot be transmitted until the electronic signal connection exists, and wherein the safety device has a safety transmitter by which a termination signal preventing the movement of the object can be transmitted, wherein the safety transmitter can be deactivated when the safety control connection is established.

12. The remote control arrangement according to claim 11, wherein a blocking control signal preventing the movement of the object can be transmitted from the portable computer and can be deactivated when the safety control connection is established and can be activated by actuation of the operating element.

13. The remote control arrangement according to claim 11, wherein the existence of the safety control connection of the computer with the safety device can be signalled on the computer.

14. The remote control arrangement according to claim 11, wherein a working area of the remote-controlled object can also be shown on a display of the computer.

15. A remote control arrangement comprising:

a portable computer, on which a computer program for generating and transmitting control signals with a transmitter provided on the computer is stored;

a remote-controlled object, on which a receiver configured to receive the control signals and a controller configured to control the object in accordance with the received signals are provided; and a safety device having an operating element that can be mechanically actuated, wherein a safety control connection can be established between the safety device and the portable computer, and control of the object can be allowed only when the safety control connection is established, wherein the safety control connection comprises an electronic signal connection between the safety device and the computer, wherein the control signals for moving the object cannot be transmitted until the electronic signal connection exists, wherein the safety device has a safety transmitter by which a termination signal preventing the movement of the object can be transmitted, wherein the safety device has a signal converter by which the control signals issued by the computer can be changed and transmitted from the safety device, and wherein the signal converter has an amplifier by which the control signals generated by the computer can be transmitted by the safety device at a higher transmission power.

16. The remote control arrangement according to claim 15, wherein the signal converter device has converter by which the control signals received by the computer in a first format can be converted into a second format in which the control signals can be transmitted from the safety device.

17. A method for operating the remote control arrangement according to claim 1, comprising activating the computer program, wherein, after activation of the computer program on the portable computer, the method comprises the steps of:

in a first step, preventing the movement of the remote-controlled object;

in a subsequent second step, checking an existence of the safety control connection;

if the safety control connection exists, in a subsequent third step, activating the transmission of control signals in accordance with control commands input on the computer; and in a subsequent fourth step, preventing the movement of the remote-controlled object again, if the safety control connection is interrupted or if a termination signal is received from the safety device.

18. The method according to claim 17, wherein the movement of the remote-controlled object is prevented by the transmission of termination signals from the safety device.

19. The method according to claim 17, wherein the movement of the remote-controlled object is prevented by the transmission of termination signals from the portable computer.

20. The method according to claim 17, wherein in the third step in addition an indication is activated on the display, by which the existence of the safety control connection and thus the possible transmission of control signals is indicated.

* * * * *